United States Patent [19]

Yamada

[11] 4,064,376

[45] Dec. 20, 1977

[54] SOUND REPRODUCTION SYSTEM AND DEVICE

[75] Inventor: Kyota Yamada, Hatogaya, Japan

[73] Assignee: Bodysonic Kabushiki Kaisha, Tokyo, Japan

[21] Appl. No.: 673,478

[22] Filed: Apr. 5, 1976

[30] Foreign Application Priority Data

| | | |
|---|---|---|
| Apr. 8, 1975 | Japan | 50-42585[U] |
| Jan. 31, 1976 | Japan | 51-10473[U] |
| Jan. 31, 1976 | Japan | 51-10474[U] |

[51] Int. Cl.[2] ..... H04R 1/02

[52] U.S. Cl. ..... 179/146 H; 128/33

[58] Field of Search ..... 179/140 H, 181 W

[56] References Cited

U.S. PATENT DOCUMENTS

| | | | |
|---|---|---|---|
| 3,366,749 | 1/1968 | Ries | 179/115.5 R |
| 3,556,088 | 1/1971 | Leonardini | 128/33 |
| 3,880,152 | 4/1975 | Nohmura | 128/33 |

*Primary Examiner*—William C. Cooper

*Attorney, Agent, or Firm*—James C. Wray

[57] ABSTRACT

A sound frequency reproduction system and apparatus has a chair for a human. A transducer is vibrated by a sound signal of appropriate frequency. The vibrating shaft of the transducer is directly fitted to the framework of the chair. The sound signal is provided to an acoustic device, including a speaker, located near the chair.

21 Claims, 14 Drawing Figures

SOUND REPRODUCTION SYSTEM AND DEVICE

BACKGROUND OF THE INVENTION

The wonderfulness of live music comes from the facts that in addition to the fundamental notes of musical instruments several high harmonics reach the ears of humans appreciating the music and that the so-called undertones of less than 150 Hz directly vibrate the human body.

Various improvements and contrivances have been made to bring the recorded or taped music closer to live music, and a considerably high fidelity of sound reproduction has been attained. Nevertheless there is left room to be desired in direct transmission of vibration to the human body.

In this connection attention is drawn to the U.S. Pat. Nos. 3,384,710 and 3,416,804 which disclose devices with speakers buried in the cushions of chair backs and to the U.S. Pat. No. 3,452,836 which discloses a device with a speaker attached to the side of a chair shaped like a shell which encloses a sitting human.

SUMMARY OF THE INVENTION

An object of the present invention, which relates to a sound reproduction device, is to provide a reproduced music with an abundant effect of presence by driving the reproducing system and at the same time applying a pleasant vibration synchronized with the reproduced sound to the human seat by means of a transducer.

For the purpose of transmitting the vibration from the transducer to the human seat, the vibrating shaft of the transducer is directly fitted to the framework of the human seat. Such a connection to the framework better vibrates the part of the body of a sitting human contacting the seat than a transducer buried in a cushion.

The fixed position of the transducer relative to the framework is important. The most desirable position is to be near the caudal bone of a human listening to music. The reason is that, when a fleshy part of the human body is vibrated by the transducer, the vibration is mitigated by the flesh but when the vibration occurs near the caudal bone, the vibration is well transmitted from the caudal to the other bones.

In this invention a transducer in the prior art may be employed, and the framework may be composed of a main frame constituting the chair and a sub-frame, or it may be a single shell framework fabricated of synthetic resin, such as for example, FRP.

Other objects of the present invention will become apparent from the description of embodiments referring to the attached drawings.

DETAILED DESCRIPTION OF THE DRAWINGS

Figure 1:
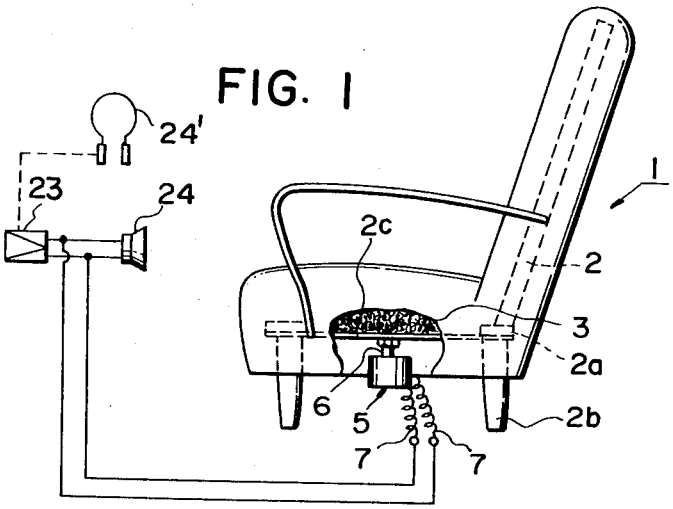
FIG. 1 is a partially cutaway side view of one embodiment of the present invention.

FIG. 1, 1 is a side elevation of a chair or a sofa. Sofa 1 consists of framework 2 and cushioning 3. Framework 2 consists of the outline frame or main frame 2*a*, legs 2*b* and sub-frame 2*c* of metal screen, etc., attached to main frame 2*a* near the seat. In the present specification main frame 2*a* refers to a skeleton constituting a chair, sofa or bed, etc., and sub-frame 2*c* refers to the other part.

To sub-frame 2*c* is attached vibrating shaft 6 of transducer 5, such that practically the whole weight of the transducer is borne by said vibrating shaft. Transducer 5, as described later, is connected through lead 7 to the output side of a sound amplifier.

Figure 2:
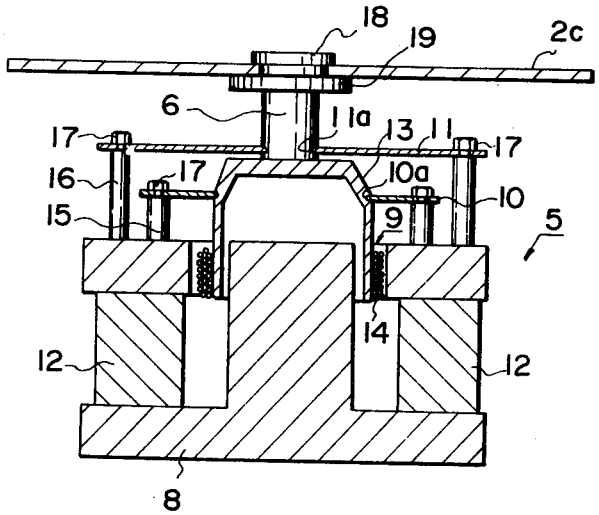
FIG. 2 is a partial longitudinal sectional detail view of the transducer and its connection to the chair frame.

Referring to FIG. 2, the detail of transducer 5 is described. Transducer 5 is composed of yoke 8 fabricated of a magnetic material, drive coil 9, installed withdrawably at the center of yoke 8, vibrating shaft 6 integrated with drive coil 9, and first and second annular dampers 10 and 11, holding said vibrating shaft 6 against yoke 8.

Yoke 8 as illustrated has a T-cap section to which peripherally is attached annular permanent magnet 12. Drive coil 9 is composed of coil frame 13, shaped like a downward-open cup, and coil 14. A sound signal flows via the lead 7 (FIG. 1) through coil 14.

First damper 10 and second damper 11 are elastic metal discs having central holes 10*a* and 11*a* which receive and hold coil frame 13 and vibrating shaft 6. Posts 15 and 16 link yoke 8 and first and second dampers 10 and 11. Nuts 17 are tightening nuts.

The top end of vibrating shaft 6 is formed as a flange 18. Sub-frame 2*c* is fastened between flange 18 and tightening nut 19, and the whole transducer 5 is suspended from sub-frame 2*c*.

In sofa 1 thus constituted, when there is passed through coil 14 a current of less than, say 150 Hz., i.e., the frequency which can effectively cause vibration of sub-frame 2*c*, as a sound output from the amplifier 23 (FIG. 1), drive coil 9 vibrates in relation to yoke 8 through magnetic interference. The vibration thus produced is transmitted via vibrating shaft 6 to subframe 2*c*, thereby giving a pleasant vibration to a human sitting on sofa 1. That vibration is synchronized with the sound from speaker 24 located in front of sofa 1 and has a synergistic effect. Moreover, a circuit of a headphone or earphone 24' may be selectively connected to the output of the amplifier 23. In this connection, a speaker discribed in the claims includes the speaker 24, headphone and earphone 24' as shown in FIG. 1.

Since yoke 8 is suspended from vibrating shaft 6 and drive coil 9 by means of first and second dampers 10 and 11, naturally yoke 8 vibrates, but this vibration is a relative one causing vibration of drive coil 9, which vibration is then transmitted to sub-frame 2*c*.

Figure 3:
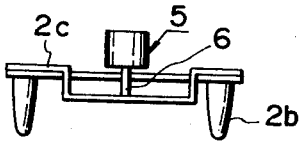
FIG. 3 is a detail side view of those principal parts in another embodiment of the present invention.

In another embodiment of the present invention illustrated in FIG. 3, vibrating shaft 6 of transducer 5 comes above sub-frame 2*c*. In the following description the same or similar parts as in the above embodiment are denoted by the same symbols.

As stated in the above embodiment, the most remarkable effect of the present invention is attained when transducer 5 is impressed with a part of the amplified sound output in the reproduced music, whereby music can be appreciated through the ears and the whole body. When applied to a bed for action in sleep, the present invention induces satisfactory sleeping.

Figure 4:
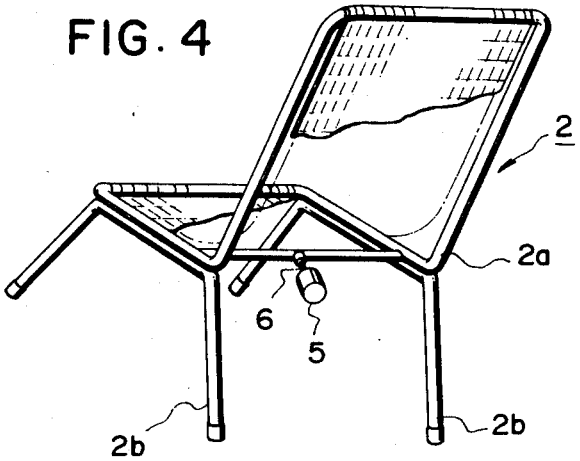
FIG. 4 is a rear perspective view showing a transducer attached to a chair main frame in another embodiment of the present invention.

Transducer 5 may be variously positioned as described in the following:

FIG. 4 illustrates transducer 5 as directly attached to main frame 2*a*. In this example, the main frame 2*a* and legs 2*b* are metal pipes; an appropriate subframe, not shown, to support the human body is attached to main frame 2*a*. The seat and back of the framework are padded with cushioning or covered with cloth. In the case of transducer 5 being directly attached to main frame 2*a*, the vibration applied to the chair is transmitted to the floor. Therefore, it is necessary to provide an appropriate anti-vibration rubber pad between legs 2*b* and the floor.

Figure 5:
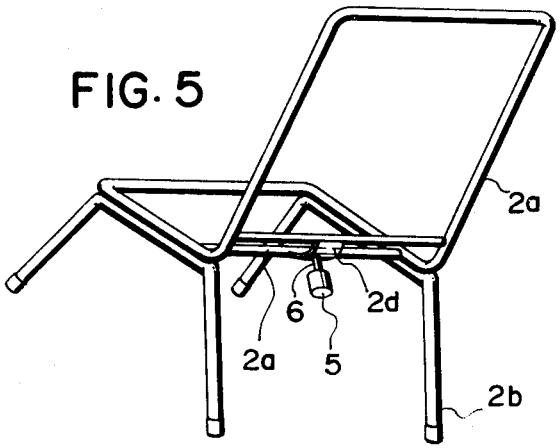
FIG. 5 is a rear perspective view showing a transducer attached to a metal plate fitted to the chair main frame in a fourth embodiment of the present invention.

FIG. 5 illustrates transducer 5, attached at its vibrating shaft to metal vibrator plate 2*d* welded to metal pipe main frame 2*a*.

Figure 6:
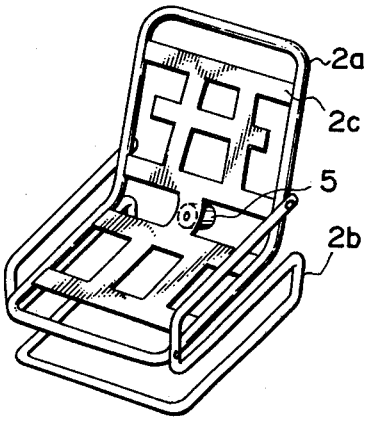
FIG. 6 is a perspective view showing a transducer attached to a sub-frame of a chair in a fifth embodiment of the present invention.
Figure 7:
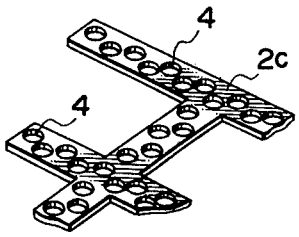
FIG. 7 is a partial detail of the sub-frame made of perforated board.

In FIG. 6, just as in FIG. 1, sub-frame 2*c* is welded or riveted to main frame 2*a*, and transducer 5 is attached to sub-frame 2*c*. The only difference is that ribbed sub-frame 2*c* is constituted of a single plate. Of course the top and periphery of sub-frame 2*c* are padded with cushioning. The ribbed sub-frame refers to one in which the members run in both lateral and vertical directions. Sub-frame 2*c* may be a single perforated steel plate with a number of holes 4 punched therein, as shown in FIG. 7.

If sub-frame 2*c* is composed of a leaf spring or a perforated plate, and transducer 5 is attached thereto, the vibration from the transducer will be soft and will be not likely to transmit overtones, thereby giving a pleasant vibration to the sitting human. To achieve that result it is possible as illustrated in FIG. 5 to fix metal vibrator plate 2*d* to sub-frame 2*c* and to attach transducer 5 to metal plate 2*d*.

Figure 8A:
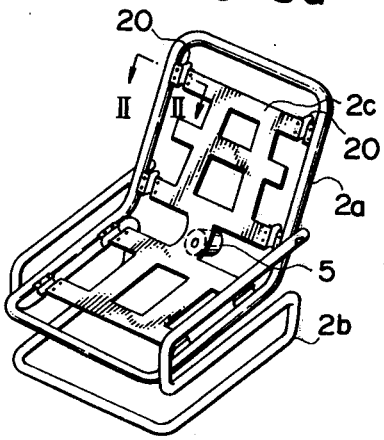
FIG. 8*a* is a perspective view showing the subframe attached with springs to the main frame in a sixth embodiment of the present invention.
Figure 8B:
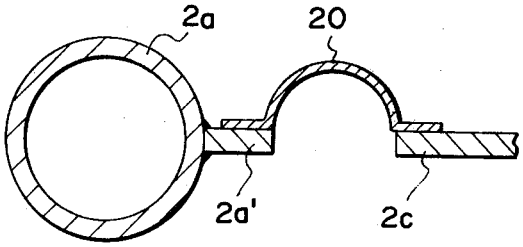
FIG. 8*b* is an enlarged sectional detail view along line II — II of FIG. 8*a*.
Figure 11:
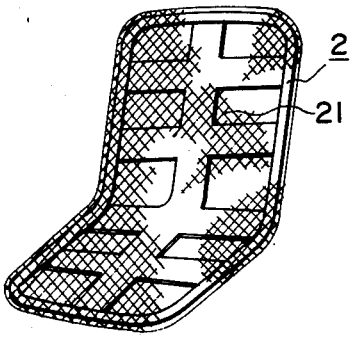
FIG. 11 is a perspective view of the framework of the chair of FIG. 9 as covered with a cloth of coarse texture.

In some embodiments sub-frame 2*c* is directly welded or screwed to main frame 2*a*. As illustrated in FIGS. 8*a* and 8*b* springs 20 may be inserted to control or reduce transmission of vibrations from sub-frame 2*c* to main frame 2*a*. Springs 20 are connected to main frame extensions 2*a'* and to edges of sub-frame 2*c*.

In other embodiments illustrated in FIGS. 9, 10*a*, 10*b* and 11, ribbed framework 2 consisting of a seat and back is covered peripherally and overall with cloth 21 of course texture (FIG. 11) and further with a foamed synthetic resin layer 22, such as foamed urethane resin.

Figure 10A:
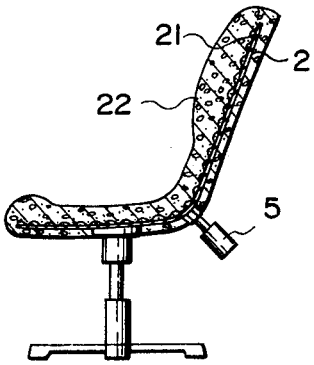
FIG. 10*a* is a longitudinal sectional view corresponding to FIG. 9.
Figure 10B:
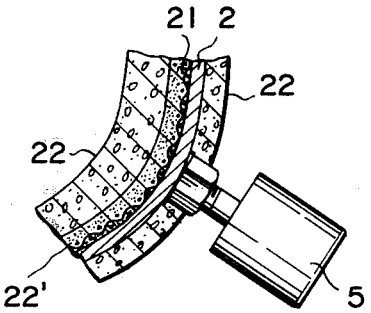
FIG. 10*b* is an enlarged detail of the transducer and part of the chair of FIG. 10*a*.
Figure 9:
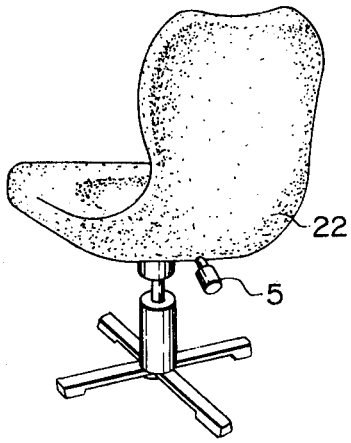
FIG. 9 is a rear perspective view of a seventh embodiment of the present invention.

If framework 2 as covered with cloth 21 of coarse texture is placed in a mold and a foamed synthetic resin is poured therein, the synthetic resin in contact with said coarse texture cloth will not so vigorously foam, resulting in the more dense or lesser foamed layer 22' as shown in FIG. 10*b*. When transducer 5 fixed to framework 2 is caused to vibrate, the synthetic resin layer as a whole will be vibrated, whereby the more foamed top portion will absorb the overtones and the sitting human will be able to sense only the undertones as a pleasant vibration.

In this connection, it may be understood that foamed synthetic resin layers can be formed around the frames illustrated in FIGS. 4, 5, 6 and 8.

Figure 12:
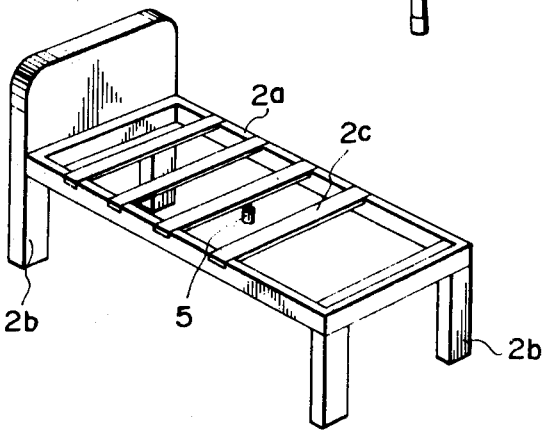
FIG. 12 is an oblique view of the framework of a bed with a transducer attached according to the present invention.

In the example illustrated in FIG. 12 transducer 5 is attached to sub-frame 2*c* of the bed framework, and the cushioning is omitted. Transducer 5 is desirably positioned at the sleeper's waist.

In the present invention beds, sofas or preferably chairs or like devices for holding humans are referred to as furniture.

As shown in FIG. 1 and as used in all embodiments, transducer 5 is connected to input means which are leads 7, which are in turn connected to an acoustic device 20' with a speaker 21'.

While the invention has been described with reference to a specific embodiment, modification and variations may be made without departing from the scope of the invention. The scope of the invention is defined in the following claims.

What is claimed is:

1. Sound frequency reproduction apparatus comprising an article of furniture for holding a human, a frame to constitute said article, a transducer connected to said frame and signal input means connected to said transducer for vibrating the transducer by a signal of appropriate frequency, and an acoustic device connected to said signal input means, to cause vibration of said acoustic device by a signal of appropriate frequency, said acoustic device including a speaker.

2. Sound frequency reproduction apparatus of claim 1, wherein said article of furniture is a chair.

3. Sound frequency reproduction apparatus of claim 1, wherein said article of furniture is a bed.

4. Sound frequency reproduction apparatus of claim 1, wherein said frame comprises a main frame and a sub-frame directly connected to said main frame.

5. Sound frequency reproduction apparatus of claim 4, wherein said sub-frame is a ribbed structure.

6. Sound frequency reproduction apparatus of claim 1, wherein said frame comprises a main frame and a sub-frame connected via springs to said main frame.

7. Sound frequency reproduction apparatus of claim 6, wherein said sub-frame is a ribbed structure.

8. Sound frequency reproduction apparatus of claim 1, wherein said frame is a main frame and wherein said transducer is attached to said main frame.

9. Sound frequency reproduction apparatus of claim 1, further comprising a metal plate connected to said frame and wherein said transducer is fixed to said metal plate attached to said frame.

10. Sound frequency reproduction apparatus of claim 1, wherein said frame comprises a main frame and a sub-frame connected to said main frame, and transducer being attached to said sub-frame of the frame.

11. Sound frequency reproduction apparatus of claim 1, further comprising a metal plate connected to said sub-frame and wherein said transducer is fixed to said metal plate attached to the sub-frame of the frame.

12. Sound frequency reproduction apparatus of claim 10, wherein said sub-frame of the frame is a plate.

13. Sound frequency reproduction apparatus of claim 10, wherein said sub-frame of the frame is perforated.

14. Sound frequency reproduction apparatus of claim 1, wherein said frame comprises a ribbed structure, upon the top of which is formed a cloth layer of coarse texture; and further comprising a foamed synthetic resin layer integrally covering said frame and said cloth layer, thereby constituting a seat for a human.

15. Sound frequency reproduction apparatus of claim 1, wherein said transducer has a vibrating shaft and wherein said vibrating shaft is connected to the frame.

16. Sound frequency reproduction apparatus of claim 15, wherein the transducer is supported by said shaft.

17. Sound frequency reproduction apparatus of claim 1, wherein the frame of the article of furniture has a portion which is constructed to be closest a caudal bone of a human on the article of furniture and wherein the transducer is connected to that portion of the frame.

18. Sound frequency reproduction apparatus of claim 17, wherein the article of furniture has a seat and the said portion of the frame constitutes a portion of the frame nearest a rear of the seat whereby the transducer is positioned on the frame in close proximity to a caudal bone of a human seated on the seat.

19. Sound frequency reproduction apparatus of claim 1, wherein said speaker is positioned adjacent the chair, spaced from the transducer.

20. Sound frequency reproduction apparatus of claim 1, wherein the transducer comprises a yoke have a substantial mass, a permanent magnet connected to the yoke, pole pieces connected to the permanent magnet having poles, a coil positioned adjacent poles of the magnet, a coil frame connected to the coil and a shaft connected to the coil frame, means for resiliently connecting the shaft and coil frame to the magnet and yoke, and means for connecting the shaft to the frame.

21. The apparatus of claim 20 wherein the yoke and permanent magnet comprise concentrically spaced circular poles, and wherein the coil frame comprises a cup shaped device having an open end, and wherein the open end and the drive coil mounted thereon are positioned within a space between the poles, and wherein a closed end of the cup shaped frame is connected to the shaft, and wherein the resilient means comprise first and second washer shaped dampers connected between an outer magnet pole and the shaft and cup shaped coil frame.

* * * * *